US008376471B2

(12) United States Patent
Chanthabane et al.

(10) Patent No.: US 8,376,471 B2
(45) Date of Patent: Feb. 19, 2013

(54) ANGLED FIBROUS BRUSHES OF FIBERS FIXED TO A BACKING AND METHOD OF MANUFACTURING SAME

(75) Inventors: Thongdy Chanthabane, Farmington, NY (US); Yogesh Vitthal Borkar, Rochester, NY (US)

(73) Assignee: Ultrafab, Inc., Farmington, NY (US)

( * ) Notice: Subject to any disclaimer, the term of this patent is extended or adjusted under 35 U.S.C. 154(b) by 830 days.

(21) Appl. No.: 12/448,919

(22) PCT Filed: Jan. 23, 2008

(86) PCT No.: PCT/US2008/000821

§ 371 (c)(1),
(2), (4) Date: Jul. 15, 2009

(87) PCT Pub. No.: WO2008/091599

PCT Pub. Date: Jul. 31, 2008

(65) Prior Publication Data

US 2009/0322144 A1 Dec. 31, 2009

Related U.S. Application Data

(60) Provisional application No. 60/881,990, filed on Jan. 23, 2007.

(51) Int. Cl.
*A46D 3/04* (2006.01)

(52) U.S. Cl. ..... 300/21; 300/4

(58) Field of Classification Search ..... 300/2, 3, 300/4, 5, 8, 11, 21; 428/85, 95
See application file for complete search history.

(56) References Cited

U.S. PATENT DOCUMENTS

| | | | | |
|---|---|---|---|---|
| 4,148,953 | A | 4/1979 | Horton | |
| 4,302,494 | A * | 11/1981 | Horton | 428/95 |
| 4,681,426 | A | 7/1987 | Bean et al. | |
| 5,338,382 | A | 8/1994 | Johnson et al. | |
| 5,807,451 | A | 9/1998 | Johnson | |
| 5,817,390 | A | 10/1998 | Johnson | |
| 7,025,105 | B2 | 4/2006 | Lancina | |
| 2006/0051553 | A1 | 3/2006 | Kaplo et al. | |

FOREIGN PATENT DOCUMENTS

| | | |
|---|---|---|
| WO | WO 03/100151 | 12/2003 |

* cited by examiner

*Primary Examiner* — Robert Scruggs
(74) *Attorney, Agent, or Firm* — George R. McGuire; Bond Schoeneck & King

(57) ABSTRACT

Angled fiber pile brushes are anchored to a backing at a predetermined angle to the perpendicular are made by winding yarn around a flat band The pile is anchored to a backing which is disposed at the desired angle to the band The band wrapped with the pile and the backing move together along an assembly path Ultrasonic horns each have a split end, which moves perpendicular to the backing Mechanisms guide the backings and the band each include a slotted plate oπented at the requisite angle The edge of the pile wrapped band extends through the slot in the guide into contact with the backing The band and the horn move in the same, horizontal plane, thereby simplifying the construction of the assembly apparatus The wrapped yam may be slit longitudinally by a slitter in the direction o the travel to provide a pair of angled brushes.

6 Claims, 9 Drawing Sheets

FIG. 4B
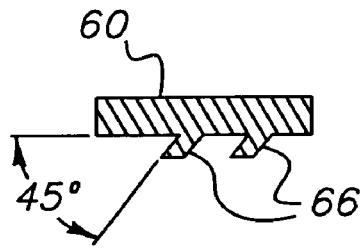
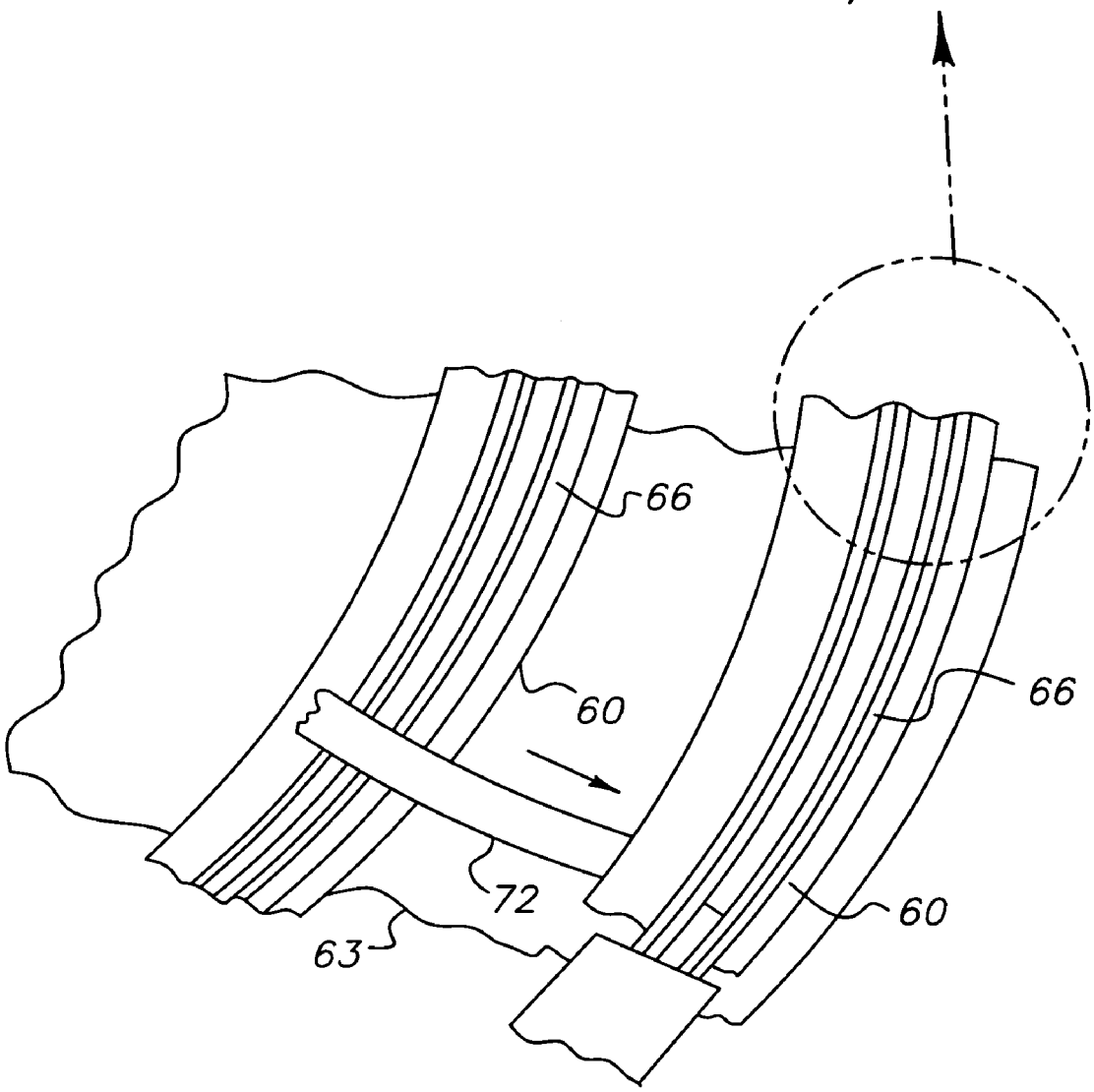
FIG. 4A

ANGLED FIBROUS BRUSHES OF FIBERS FIXED TO A BACKING AND METHOD OF MANUFACTURING SAME

Priority is claimed to U.S. Provisional Patent Application Ser. No. 60/881,990, filed Jan. 23, 2007.

The present invention relates to angled fibrous brushes where the fiber brush is anchored to a backing at a desired angle away from a perpendicular to the backing. The invention provides an improved process and apparatus for carrying out the process which enables angled fiber brushes to be made by utilizing a traveling band or mandrel on which the fibers constituting the pile are wrapped as the wrapped band and backing move along an assembly path.

It is a feature of the present invention to provide a process and apparatus for carrying out the process which enables the wrapped band and an ultrasonic horn which welds the fibrous yarn constituting the pile to the backing to be disposed in generally parallel planes, during assembly of a pair of angled brushes, and preferably planes which are horizontal, thereby facilitating an effective process whereby angled fibrous or pile articles may be assembled expeditiously and reliably.

Ultrasonic welding or anchoring a backing to a pile which is wrapped around the band has been used for many years in the manufacture of fibrous brush articles, and particularly pile weatherstripping. Reference may be had to the following patents for apparatus and techniques for making fiber brush and particularly pile articles, such as weatherstripping through the use of a band or mandrel on which a yarn is wound while the mandrel is horizontal and wherein ultrasonic welding horns are used to weld the yarn to a backing while both the yarn and the backing move along an assembly path: Robert C. Horton, U.S. Pat. No. 4,148,953 issued Apr. 10, 1979, and U.S. Pat. No. 4,302,494 issued Nov. 24, 1981, Johnson et al., U.S. Pat. No. 5,338,382 issued Aug. 16, 1994, and Johnson, U.S. Pat. No. 5,807,451 issued Sep. 15, 1998, and U.S. Pat. No. 5,817,390 issued Oct. 6, 1998.

When the brushes and pile weatherstripping are made in accordance with the well-established techniques as represented by the above referenced patents, the brush is oriented perpendicular to the backing to which it is attached by ultrasonic welding. Applications have developed for angled pile brushes where the brush is anchored to the backing, but at an angle away from a perpendicular to the backing. Such angled pile andibrush articles are used in web cleaning and electrical static dissipation applications in xerographic copiers and printers, such for example as shown in Bean et al., U.S. Pat. No. 4,681,426 issued Jul. 21, 1987. Another application for angled brushes is as guides and supports for shutters. Sets of intersecting angled brushes between which opposite sides of the shutter travels guide and sometimes seal the shutter along the opposite side thereof. See, for example, Lacina, U.S. Pat. No. 7,025,105 issued Apr. 11, 2006.

It is desirable to use the established techniques for making pile articles as represented by the above referenced Horton and Johnson patents. The use of these established techniques requires that, both the ultrasonic horn and the wrapped band be arranged in parallel and preferably horizontal relationship. The difficulties are exacerbated when the backing is formed with a channel extending from one side of the backing into which the pile is seated during welding. The channel serves as a pile director and facilitates the application of the ultrasonic energy from the horn, so as to effect the welding of the backing and the pile into an integrated pile article. Such pile director channels and techniques for upsetting the backing with a plowing tool or tools to form the channel are described in the above-identified Horton U.S. Pat. No. 4,302,495 and also in International Publication No. WO 03/100151 published Dec. 4, 2003, the publication being of Loughney International Patent Application No. PCT/US02/16612 filed May 24, 2002. In such channel forming techniques, the channel is perpendicular to the backing. In order for the pile to be disposed at an angle to the backing, the channels could project at the desired angle on the backing. Such angled channels further exacerbate the use of the established techniques as described in the above referenced Horton and Johnson patents which require the wrapped band and the ultrasonic horn to be disposed in the same parallel, horizontal planes.

A further challenge is presented by the requirement to meet certain angle brush applications which require that the angle of the brush be at a selected angle, for example, from 15° to 60° to the perpendicular to the backing. It is undesirable to orient the horn at an angle to the assembly path as defined by the wrapped band. It is a feature of the invention to provide an improved ultrasonic horn, which while movable in the plane of the wrapped band or in a plane parallel to, is able to accommodate different angles of the backing with respect to the pile necessary to produce angled pile articles.

As the description proceeds, it will be apparent that the term fiber brush articles and pile articles are used synonymously. The only difference between such articles is the density and flexibility of the fibers which may be used so as to facilitate the application of the articles, as supports, seals, weatherstripping and the like.

Accordingly, it is the principal feature of the present invention to provide techniques, and apparatus for carrying out such techniques, which are useful in the manufacture of pile articles where the pile is disposed at an angle differing from perpendicular to the backing of such articles.

It is another feature of the invention to provide techniques and apparatus for carrying out such techniques which utilize a yarn wrapped band and an ultrasonic horn which are movable in the same, preferably horizontal, plane in order to carry out the established method of making pile articles as discussed in the above referenced Horton and Johnson patents.

It is a further feature of the present invention to provide techniques and apparatus for carrying out such techniques, which are useful in the manufacture of angled pile articles, and where the angle may be selected so as to facilitate the use of the pile article in different applications as, for example, from 15° to 60° to a perpendicular to the backing of the articles.

It is a still further feature of the invention to provide in the techniques and apparatus for manufacture of angled pile articles, an improved ultrasonic horn which facilitates the selection of the desired angle of the pile with respect to the backing.

The materials used for the fibers or yarn in the angled pile articles provided by the invention and the materials used in the backings are preferably ultrasonically weldable plastic materials such as polypropylene, as mentioned in the above referenced Horton and Johnson patents and as are otherwise conventionally used in pile articles, and which are now, or may in the future, become commercially available.

Briefly described, the invention provides a method and apparatus for making pile articles, especially angled pile articles wherein the pile is disposed at a predetermined angle from the perpendicular to a backing from which the pile projects. The key feature of the method and apparatus is orienting the backing so that it travel together with the pile at the predetermined angle with respect to the band around which the fibers constituting the pile are wrapped as the backing and the band are transported together along an assembly or process path. A mechanism through which the wrapped band travels presents a surface inclined to the process path at the predetermined angle. This surface may be slotted so as to present the wrapped pile at an edge of the band to the backing. An ultrasonic horn which is movable transversely and preferably perpendicular to the process path, engages the backing opposite to the yarn on the wrapped band as it projects to the slot. In the event that a pile director channel is used on the backing, that channel also projects through the slot. Since the backing is at the predetermined angle, the pile director channel walls project in the same plane as the band. Both the traveling wrapped band and the horn are movable in the same and preferably, horizontal plane, or horizontal planes which are parallel to each other, thereby enabling the use of established wrapped band and ultrasonic welding techniques of the type described in the above referenced Horton and Johnson patents. The horn is preferably provided with a split end in the form of Y shaped or notched tip where the legs of the Y extend both upwardly and downwardly from the path along which the horn moves, which may be along an axis through the junction between the legs of the Y. These legs, at the ends thereof, are brought into contact with the backing opposite to where the yarn wrapped around the backing contacts the backing, and more particularly, where the yarn in seated in the channel. These ends are preferably arcuate, for example semi-circular (in cross section). The Y shaped legs accommodate a wide range of angles at which the backing may be disposed with respect to the pile. In other words, by moving the horn upwardly or downwardly with respect to the path of the travel, one or the other of the legs may be brought into contact with the backing.

The foregoing and other features and advantages of the invention and a presently preferred embodiment of the apparatus carrying out the invention, will become more apparent from a reading of the following description in connection with the accompanying drawings in which:

FIG. 4A is a fragmentary plan view of the apparatus shown in FIGS. 2 and 3, the view being taken generally along the line 4A-4A in FIG. 2 when viewed in direction of the arrows;

FIG. 4B is a cross sectional view of the backing made in the apparatus of FIGS. 2-4A.

Figure 1:
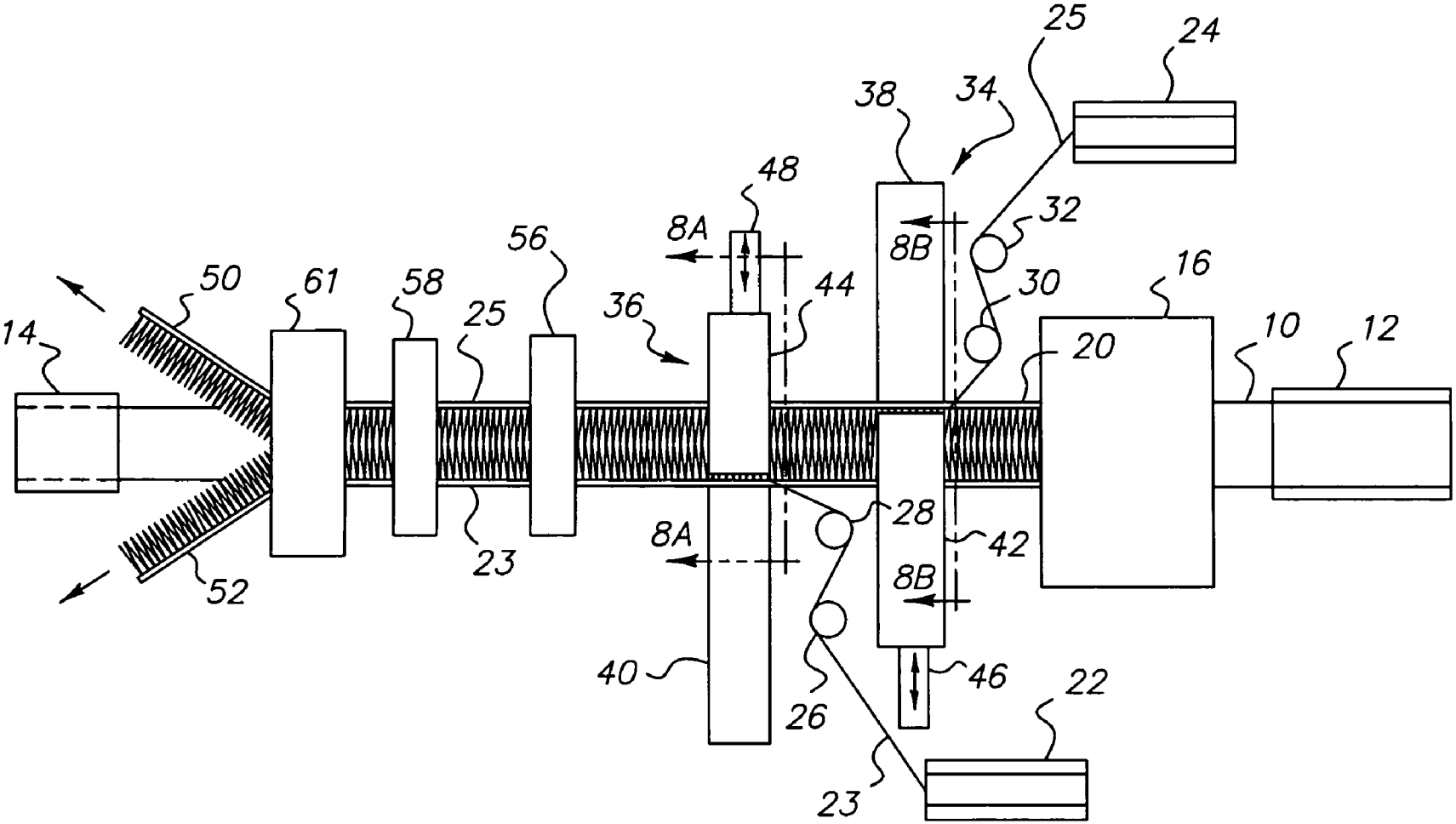
FIG. 1 is a schematic diagram illustrating an apparatus, in accordance with the present invention, whereby angled pile articles which are mirror images of each other, and thereby are especially suitable for use in shutter guides and seals, may be fabricated.
Figure 2:
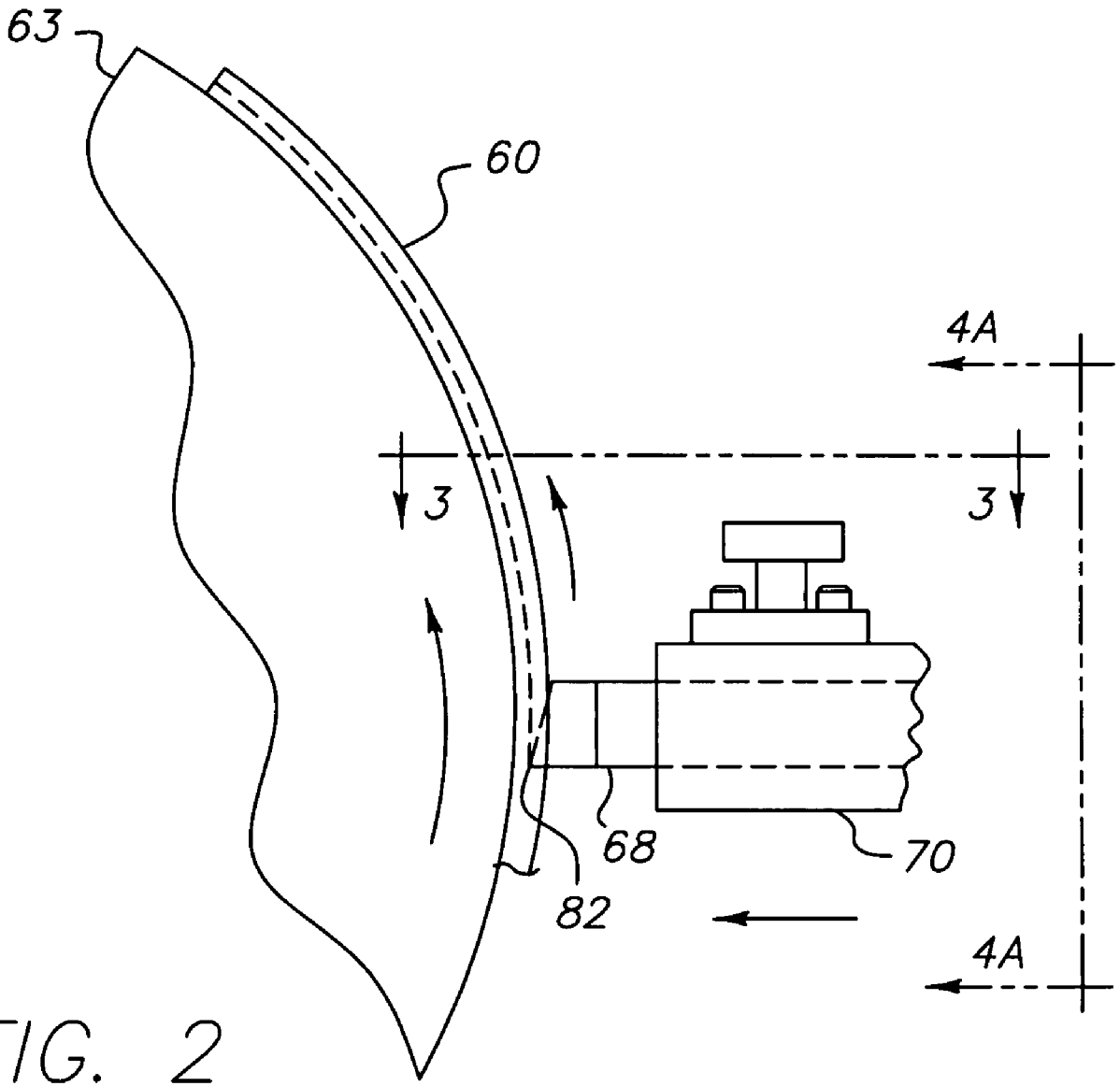
FIG. 2 is a fragmentary, elevational view of plowing apparatus for forming a pile director channel in the backing used in the pile articles made with the apparatus shown in FIG. 1.

Referring to FIG. 1, there is shown a traveling band or mandrel 10. Pulleys 12 and 14 at the opposite ends of the assembly path drive the band 10 in a direction from right to left as shown in FIG. 1. A yarn spool holder and yarn winder 16 wraps the yarn around the mandrel 10 so as to provide a helical wrapped band 20 of yarn. There may be several spools of yarn in the winder 16 depending upon the requisite density of the yarn or fibers on the wrapped mandrel 10. The wrapped band 20 of yarn appears first at the output of the winder 16. The backings 23 and 25 may be supplied from reels 22 and 24, via guide pulleys 26, 28, 30, and 32, to movable guidance and welding units 34 and 36 which are spaced from each other along the assembly path. The units 34 and 36 respectively have movable wrapped mandrel and backing guides 42 and 44 opposed to ultrasonic horn and driver fixtures 38 and 40. The yarn disposed around opposite edges of the band 10 is welded to the backing 23 and 25. Each backing is a strip of plastic 60 having a pile director channel 62 (shown as 66 in FIG. 4B when produced using plowing tool 68). Yarn is welded to the backings while seated in the pile director channels 62 projecting from the backing strips 60 toward the wrapped bands.

Figure 8A:
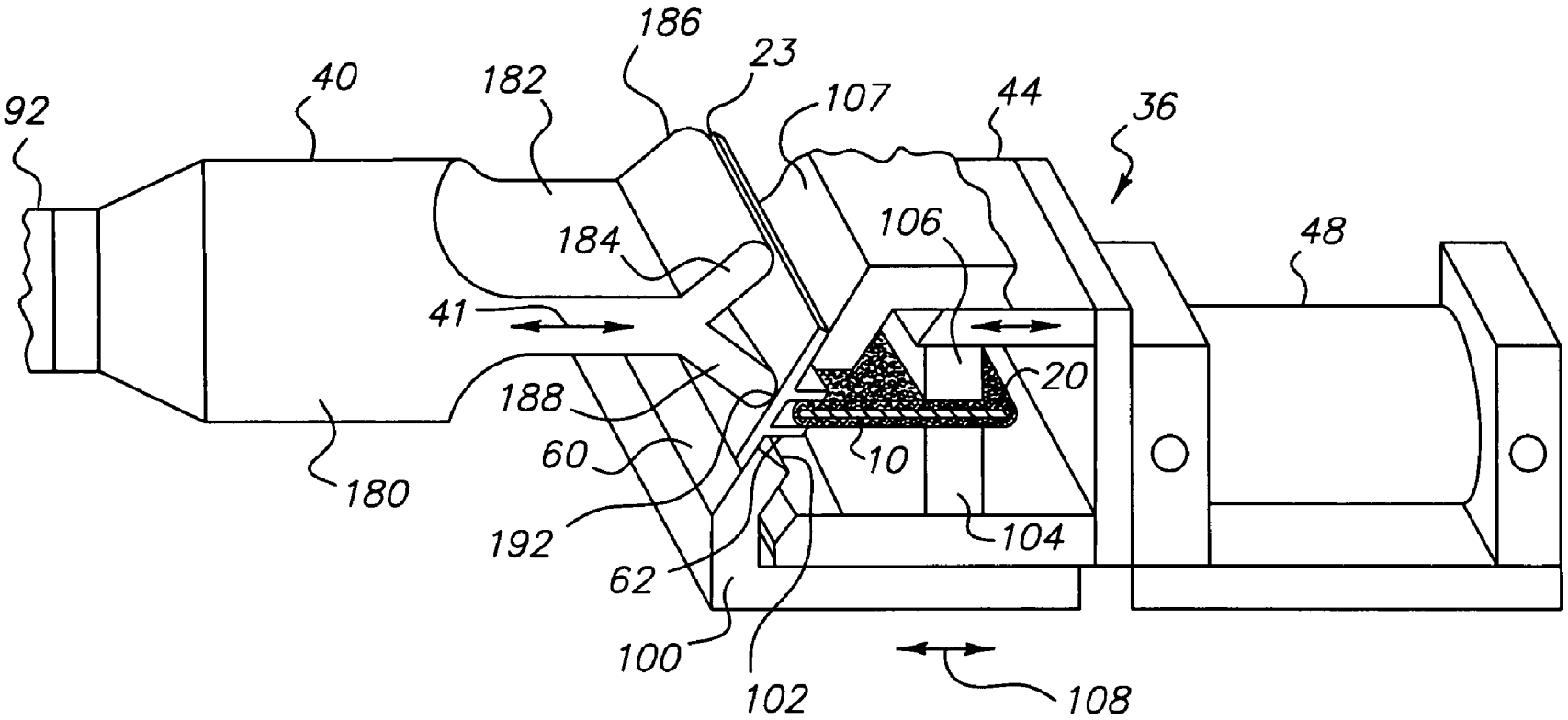
FIGS. 8A and 8B are diagrammatic, sectional views showing the assemblies of mechanisms for guiding the wrapped band, backing and ultrasonic horns, which are used in welding of pile articles, which are mirror images of each other, the views being taken along the lines 8A-8A and 8B-8B of FIG. 1 when viewed in the direction of the arrows.

As shown in greater detail in FIGS. 8A and B, the units 34 and 36, respectively consist of horn and driver fixtures 38 and 40, and backing and wrapped band guidance mechanisms 42 and 44. The mechanisms 42 and 44 are actuated by separate pneumatic cylinders 46 and 48. The wrapped band 20 and the horns 38 and 40 are disposed in horizontal planes which may be the same plane or parallel planes depending upon the angle of the pile to the backing, which is selected.

Figure 8B:
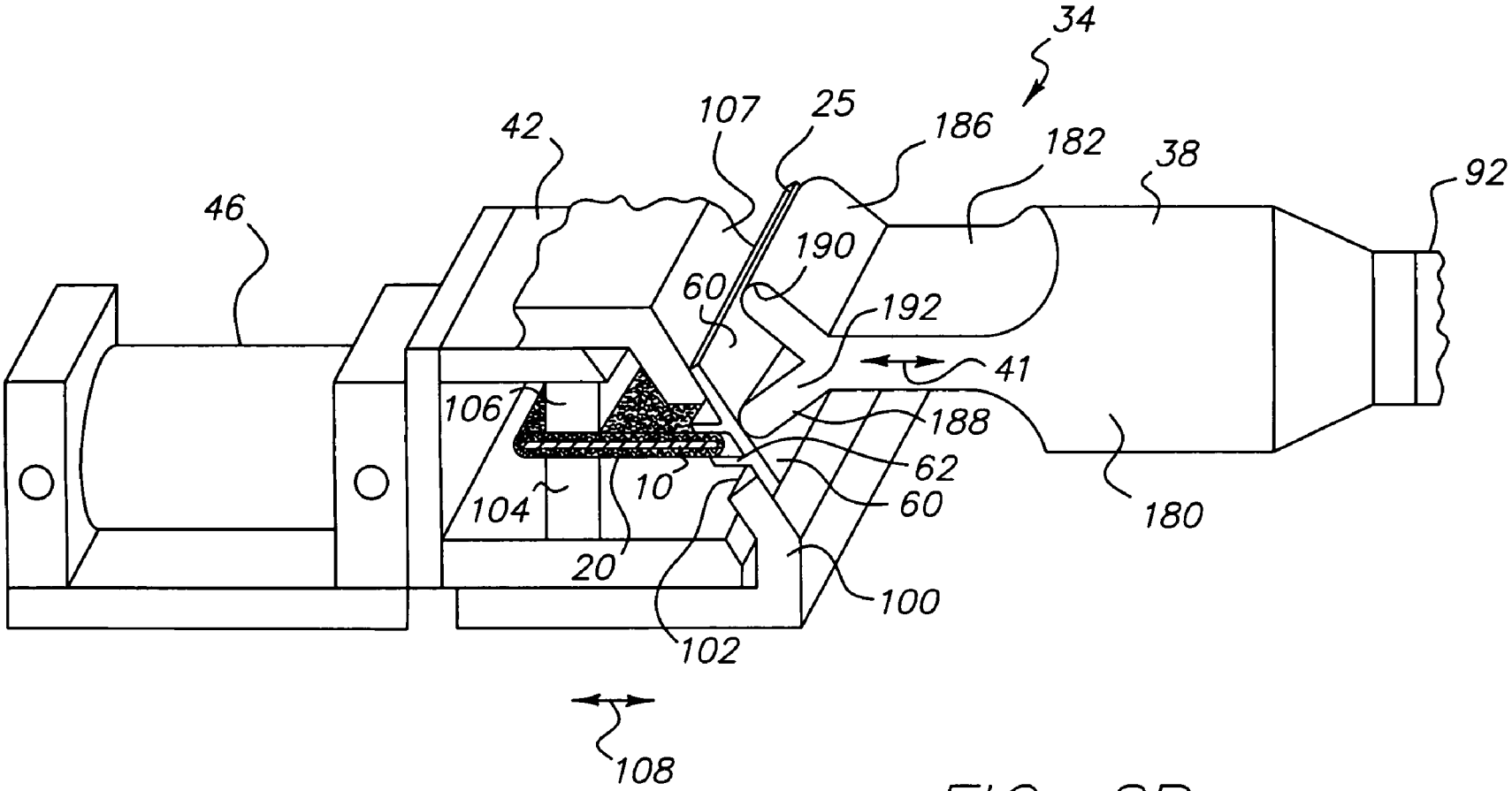

It will become more apparent from FIGS. 8A and 8B that the wrapped band 20 and the horns are disposed along horizontal planes. This geometry enables assembly of pile articles by the tried and true techniques of the above referenced Horton and Johnson patents. The geometry is obtained by orienting the backings 23 and 25 at the requisite angle, namely, the predetermined angle of the pile to the backing. These angles are obtained through the use of the mechanisms 40 and 42. These mechanisms allow the angles of the pile to the backing in a pair of angled pile articles 50 and 52, which are produced at the end of the assembly path, to be at congruent angles so that the 50 and 52 articles are mirror images of each other. Such pile articles are therefore produced simultaneously with the apparatus shown in FIGS. 1, 8A and 8B.

After the backings 23 and 25 are ultrasonically welded to the wrapped band 20 of yarn on the traveling band or mandrel 10, the backings are inclined to the process path. It is sometimes desirable to reduce the width of the backings 23 and 25. Then a backing width reducer 56 having knives which slit the backings 23 and 25 along the edges thereof are provided. The backing width reducer 56 takes advantage of a guide 58 which maintains the center of the wrapped band 20 generally horizontal. The guide 58 also aligns the band centrally of a rotating blade slitter 61 such as described in the above references Horton and Johnson patents. The slitter 61 cuts the yarn on opposite sides of the band 10 thereby releasing the two angled pile articles 50 and 52. These articles may be wound on reels and be inserted in frames, for example, when used in a shutter mechanism where the shutter slides between the angled piles as shown in the Lacina patent.

Figure 3:
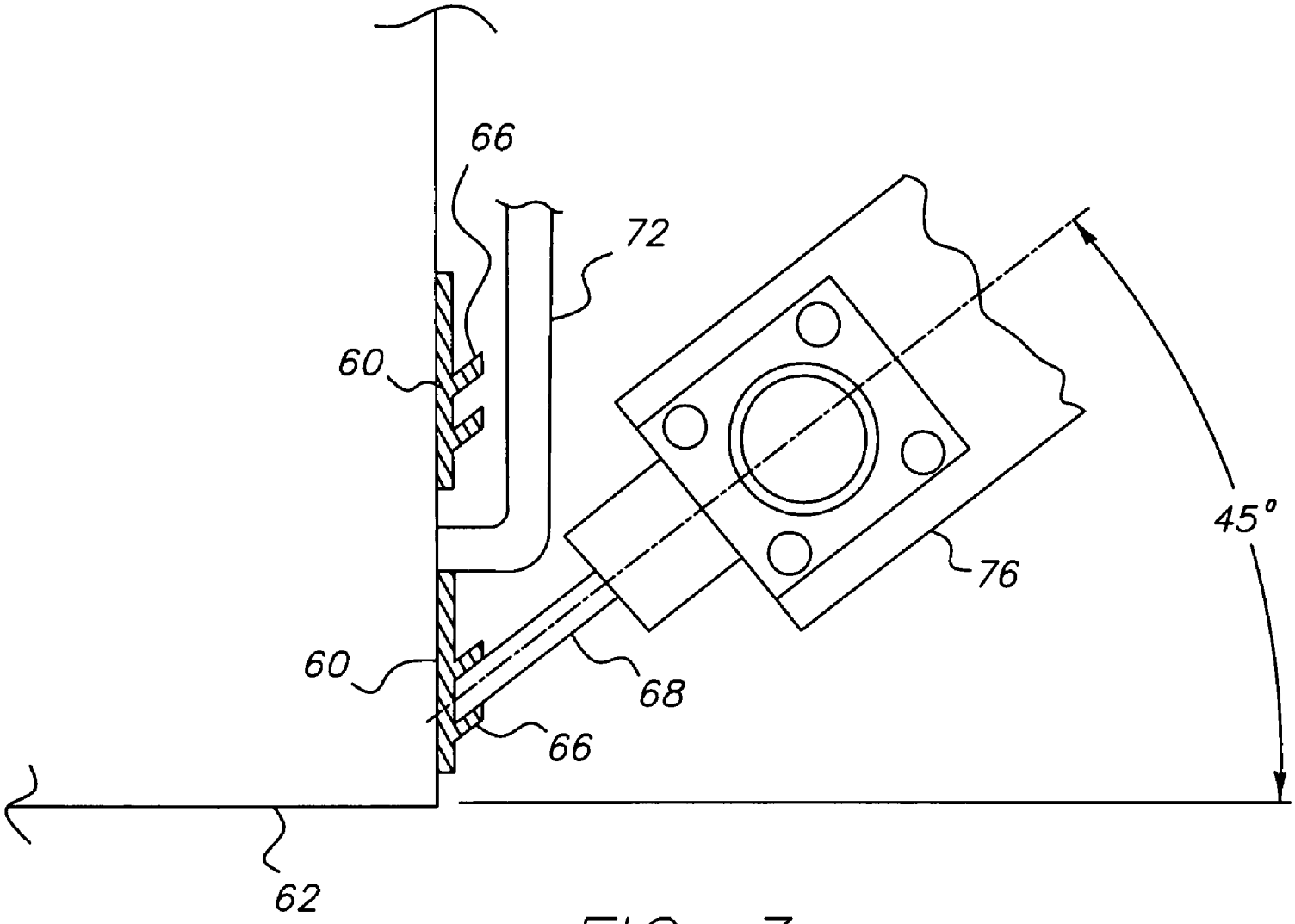
FIG. 3 is a fragmentary, sectional view of the plowing apparatus shown in FIG. 2 taken along the line 3-3 in FIG. 2 and viewed in the direction of the arrows.

The backing strips 60, providing the backings 23 and 25, may be fed into the apparatus as shown in FIG. 1 directly from a mechanism which plows a channel into one side of the backing. Such a mechanism will be more apparent from FIGS. 2-7. It will be appreciated that a pair of such mechanisms will be used for plowing channels at congruent angles in order to facilitate the fabrication of the mirror image pile articles 52 and 54. Only one of the mechanisms is shown in FIGS. 2-7. As shown in these figures several turns of backing strip are wound around a drum 63 which is driven by a motor drive not shown. The use of such a drum to enable plowing of channels in backing for pile articles is similar to that disclosed in the above referenced Loughney International Publication. A channel 66 is plowed at a predetermined angle to the surface of the backing 60 by means of a plowing tool 68 adjustably held in a tool holder 70 to provide the pile director channel 62. Separation between the turns of backing is maintained by an edge guide 72 (FIG. 3).

Figure 5:
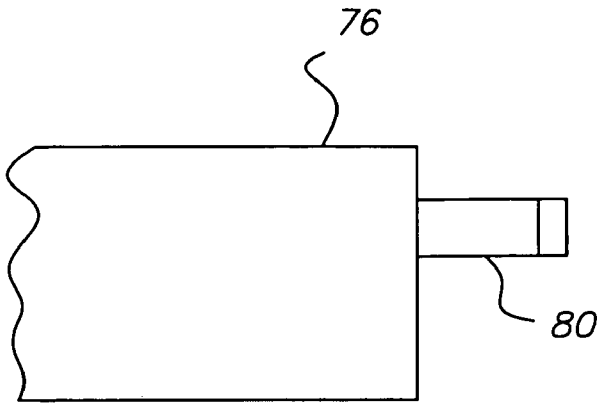
FIG. 5 is a top view of the plowing tool used in the apparatus of FIGS. 2-4.
Figure 6:
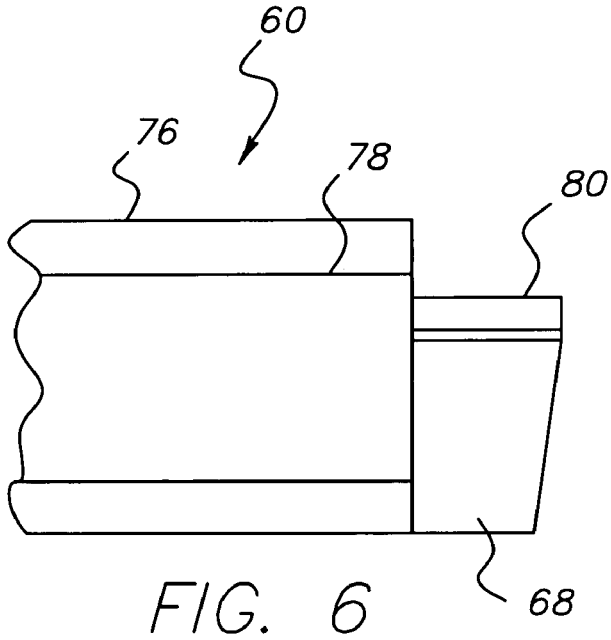
FIG. 6 is a side view of the tool shown in FIG. 5.
Figure 7:
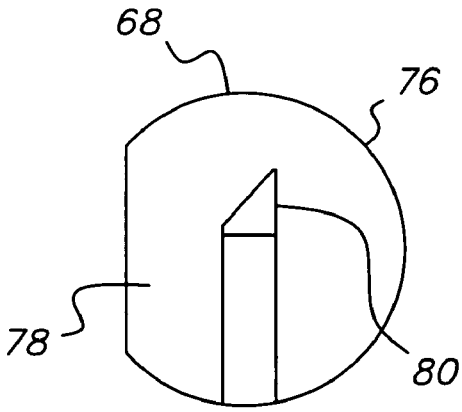
FIG. 7 is an end view of the tool shown in FIGS. 5 and 6.

The plowing tool 68 may be as shown in FIGS. 5, 6, and 7 as having a tool body 76 which is a truncated cylinder having a flat 78. The tool itself has a champhered tip 80. The point 82 enters the backing 60 and upsets the material of the backing to form the channel 66. The champher sloping away from the point 82 defines the shape of the channel 66 which is upset from the material on one side of the backing. The channel has walls and base. The channel is inclined at the preselected angle to the surface of the backing, for example, 45° to a perpendicular to the backing strip 60. The channel provides a seat for the yarn and facilities the welding of the yarn to the backing.

Referring again to FIG. 8A, there is shown the movable guidance and welding unit 36 which guides the backing 23 on the left side of the wrapped band 20 of yarn wrapped mandrel 10 and welds the yarn to the backing. It will be observed that the unit 34 shown in FIG. 8B is similar in design to the unit 36, but is oriented 180° with respect to the unit 36 so as to weld the other backing 25 to the yarn 10 on the yarn wrapped mandrel 10.

Figure 10A:
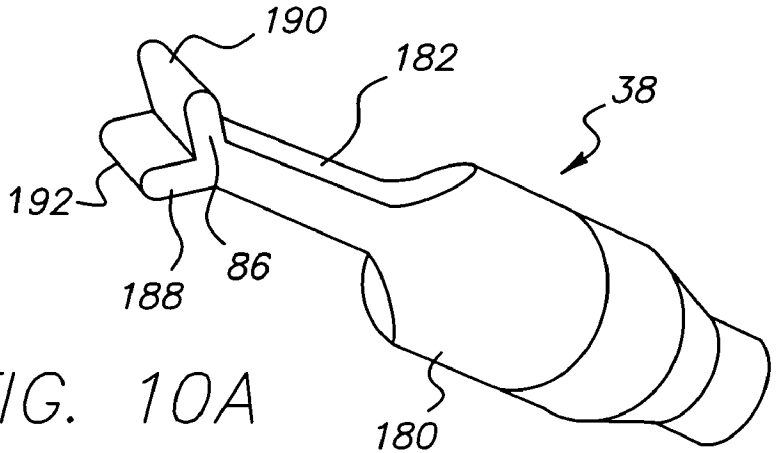
FIGS. 10A, B and C are respectively perspective, end and top views of a split end or notched tip horn provided by the invention and use in the apparatus shown in the previous FIGS.
Figure 10C:
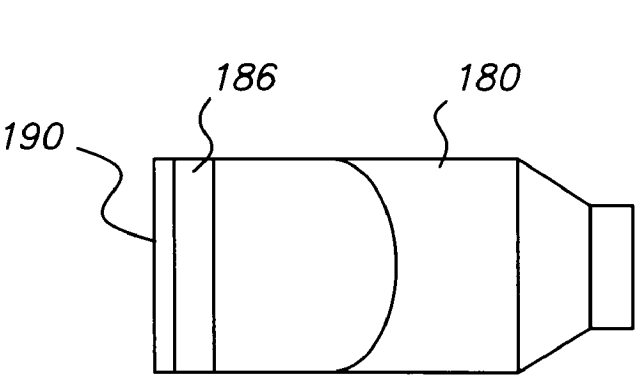
Figure 10B:
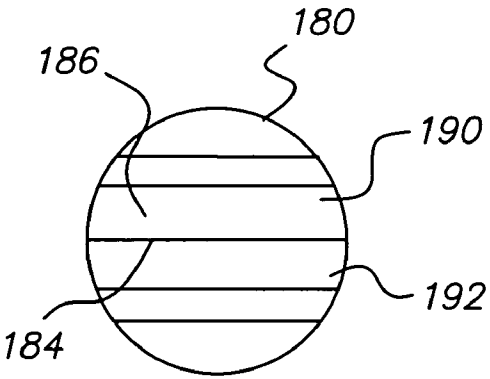

The horn and driver fixture 40 is shown in FIG. 8A. A cylindrical shank 180 of the horn 40 is connected to a conventional ultrasonic driver 92 having an electrically driven ultrasonic transducer. This transducer preferably vibrates the horn 40 at ultrasonic frequency along the axis of the horn indicated by the arrow 41. Other modes of ultrasonic vibration may be suitable. The vibration propagates through the shank 180 of the horn 40, via a coupling section 182, to the tip 184 thereof and causes arcuately shaped (for example, hemispherically shaped) end surfaces 190 and 192 of the legs 186 and 188 of the tip 184 to vibrate. The driver 92 is fixed on the frame of the machine on which the other pressing stations are mounted. The horn 38 of the unit 34 is similar to the horn 40 and is shown in FIGS. 10A, B and C, but without the driver attached thereto. Like parts of the horns 38 and 40 are identified by like reference numerals.

The backing 23 is guided by the mechanism 44. This guidance mechanism is characterized by a guide member 100 having a slot 102 sufficiently wide to admit the pile directors 62. The pile directors 62 are admitted into the guidance mechanism 44 in the horizontal plane corresponding to the horizontal plane in which the mandrel 10 wrapped yarn band 20 is guided by spacers 104 and 106 which extends longitudinally in the direction of the slot 102. This geometry is defined by the guiding surface 107 of the guidance structure 100 which is at approximately the same angle to the horizontal as the backing strip 60, when it bears against the guidance surface 106. The pile directors 62 are therefore maintained in the same plane as the wrapped mandrel 20 (see FIGS. 8A and 8B).

The pneumatic cylinder 48 which is referenced to the frame of the machine engages the guidance structure 100 so as to move it in opposite directions while maintaining the structure in guiding relationship to wrap band 20. The direction of movement of the guidance structure 100 is indicated by the double-headed arrow 108.

Figure 9:
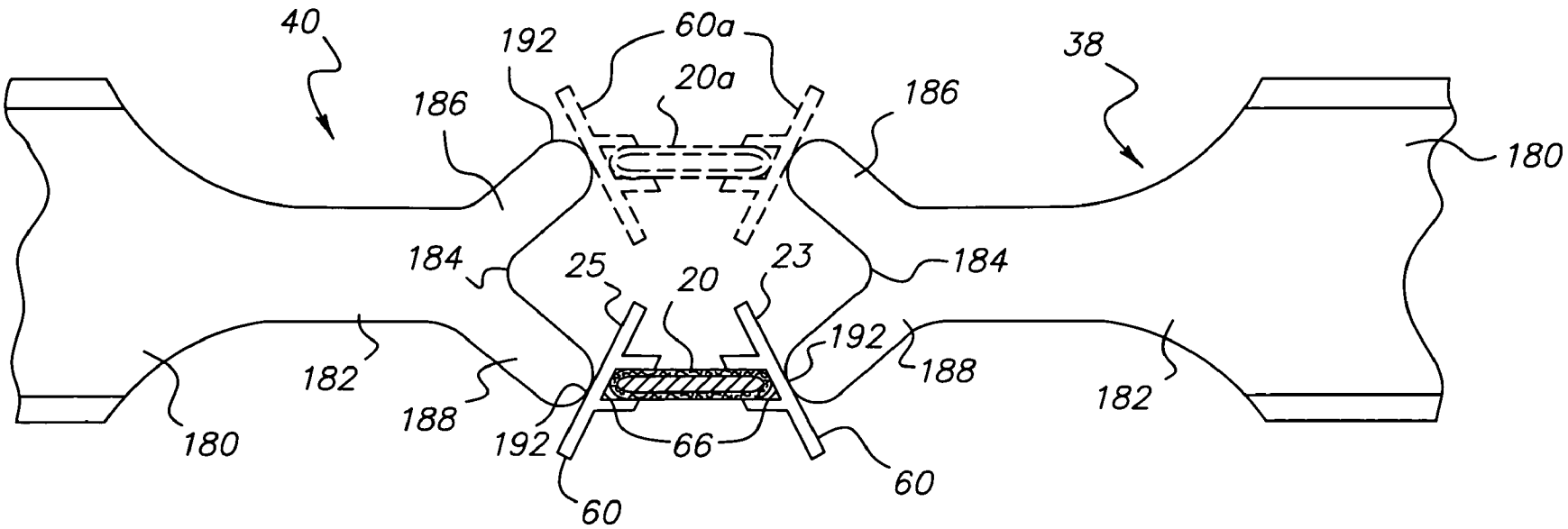
FIG. 9 is a schematic diagram showing how a split end horn, in accordance with the invention, is capable of welding angled pile articles with backings at different angles to the horizontal.

Sufficient force is applied by the piston of the cylinder 48 to hold the backing strip 60 against the end surface 192 of the leg 188 of the horn 40. The other leg 186 is not used. However, the provision of the other leg enables the horn to be used with the backing strip 60 at a different angle than shown in FIGS. 8A and B. The position of the backing strips and the wrapped yarn 20 in FIGS. 8A and B is shown in FIG. 9 by the backing strip 60 and the wrapped yarn 20 being in solid lines. The provision of the other legs 186 of the notched or Y-shaped tip of the horns 38 and 40 enables the assembly of backing **60*a* and 60, shown in dash lines, which are 180° rotated with respect to the solid line backing strips 60. Greater flexibility in the application of the apparatus is therefore provided with a Y-shaped tip 184. The arcuate ends 90 and 92 are located opposed to the center of the pile director channels 62, at the location the channels 62 in the slots 102 the fixtures due to the angular disposition to the horizontal obtained with the guidance fixture 44 shown in FIG. 8A and the fixture 42 shown in FIG. 8**B. The need for an inventory of ultrasonic horns is substantially minimized by the use of the horns with y-shaped tips.

Like parts of the units 34 and 36 are identified with like referenced numerals in FIGS. 8A and 8B. During set up, the backings 23 and 25 are threaded in the space between the horns and the guide surfaces 107 of the guidance structure 100. Then, the pistons of the pneumatic cylinders 46 and 48 are advanced to move the guidance structures 100 of the fixtures 42 and 44 towards the horns 38 and 40 so as to capture the backings 23 and 25 in between the horn tips and the surfaces 107 and with the edges of the wrapped mandrel 20 in the channel 66.

Variations and modifications in the herein described method and apparatus of making angle piled articles will undoubtedly suggest themselves to those skilled in the art. For example, additional guidance members may be associated with the guidance structure 100 so that the horns and wrapped mandrel move in the same plane which may be other than a horizontal plane as shown in the preferred embodiment described herein. Accordingly, the foregoing description should be taken as illustrative and not in a limiting sense.

The invention claimed is:

1. A method of making pile articles, the method comprising the steps of:

ultrasonically vibrating a horn member that comprises a contact surface;

during the ultrasonically vibrating step, feeding an elongated backing member through a welding zone where a rear major surface of the backing member contacts and is fed across the contact surface; and during the ultrasonically vibrating step and the feeding-an-elongated-backing-member step, feeding a wrapped band, comprising a plurality of pile members, into the welding zone so that so that a portion of a transverse edge of the generally flat band contacts a front major surface of the backing member whereby the plurality of pile members are ultrasonically welded to the backing member with energy from the ultrasonic vibration of the contact surface of the horn member;

wherein:

at the ultrasonically vibrating step, the horn member is vibrated in an at least substantially linear, back-and-forth vibration direction which is not normal to the contact surface.

2. The method of claim 1 wherein:

at the feeding-a-wrapped-band step, the wrapped band is oriented so that the portion the wrapped band in the contact zone is aligned to be at least substantially parallel with the vibration direction.

3. The method of claim 1 wherein:

at the ultrasonically vibrating step, the horn member is oriented so that the contact surface is at least 15 degrees away from being normal to the vibration direction.

4. A machine for making pile articles that includes an elongated backing member having a rear major surface and a front major surface and a plurality of pile members, the machine comprising:

an ultrasonic driver;

a horn member;

a wrapped band feeding assembly; and a backing member feeding assembly;

wherein:

the ultrasonic driver is operatively connected to the horn member so ultrasonic driver causes the horn member to vibrate ultrasonically in an at least substantially linear, back-and-forth vibration direction;

the horn member comprises a contact surface;

the backing member feeding assembly is structured and/or located to feed the backing member so that its rear major surface travels across the contact surface of the horn member to define a welding zone;

the wrapped band feeding assembly is structured and/or located to feed an elongated and generally flat wrapped band, including the plurality of pile members, so that a portion of a transverse edge of the generally flat band contacts the front major surface of the backing member located in the welding zone so that the plurality of pile members are ultrasonically welded to the backing member with energy from the ultrasonic vibration of the contact surface of the horn member; and the ultrasonic driver and horn member are further structured so that the vibration direction is not normal to the contact surface.

5. The machine of claim 4 wherein the wrapped band feeding assembly is further structured and/or located so that the portion the wrapped band in the welding zone is aligned to be at least substantially parallel with the vibration direction.

6. The machine of claim 4 wherein the ultrasonic driver and horn member are further structured so that the vibration direction is at least 15 degrees away from being normal to the contact surface.

* * * * *